US007782270B2

(12) United States Patent
Chung et al.

(10) Patent No.: US 7,782,270 B2
(45) Date of Patent: Aug. 24, 2010

(54) PLANAR INVERTED-F ANTENNA WITH EXTENDED GROUNDING PLANE

(75) Inventors: Shyh-Jong Chung, Hsinchu (TW); Ching-Wei Ling, Sinhua Township, Tainan County (TW); Yu-Chiang Cheng, Taipei (TW)

(73) Assignee: Getac Technology Corporation, Hsinchu (TW)

( * ) Notice: Subject to any disclaimer, the term of this patent is extended or adjusted under 35 U.S.C. 154(b) by 165 days.

(21) Appl. No.: 12/153,738

(22) Filed: May 23, 2008

(65) Prior Publication Data

US 2009/0115664 A1 May 7, 2009

(30) Foreign Application Priority Data

Nov. 5, 2007 (TW) ..... 96141721 A

(51) Int. Cl.
*H01Q 1/48* (2006.01)
*H01Q 9/38* (2006.01)

(52) U.S. Cl. ..... 343/846; 343/830

(58) Field of Classification Search ..... 343/700 MS, 343/702, 846, 828–830, 848
See application file for complete search history.

(56) References Cited

U.S. PATENT DOCUMENTS

| | | | | |
|---|---|---|---|---|
| 6,844,853 | B2 * | 1/2005 | Tai et al. | 343/700 MS |
| 7,113,133 | B2 * | 9/2006 | Chen et al. | 343/700 MS |
| 2003/0234742 | A1 | 12/2003 | Tai et al. | |
| 2004/0012528 | A1 | 1/2004 | Dai et al. | |
| 2005/0134509 | A1 | 6/2005 | Lin | |
| 2007/0109200 | A1 | 5/2007 | Su | |

* cited by examiner

*Primary Examiner*—Michael C Wimer
(74) *Attorney, Agent, or Firm*—Quintero Law Office, PC

(57) ABSTRACT

Disclosed is a planar inverted-F antenna with an extended grounding plane. The planar inverted-F antenna has a grounding metal plate having a selected side edge on which the extended grounding plane is formed and has a predetermined height. At least one antenna signal radiating plate is connected to the grounding metal plate by a short-circuit piece and is substantially parallel to and spaced from the grounding metal plate by a distance. A feeding point extends from the antenna signal radiating plate in a direction toward the grounding metal plate and corresponds to the extended grounding plane with a predetermined gap therebetween. With the arrangement of the extended grounding plane, the impedance matching of the antenna is improved and the impedance bandwidth of the antenna is increased.

16 Claims, 7 Drawing Sheets

PLANAR INVERTED-F ANTENNA WITH EXTENDED GROUNDING PLANE

FIELD OF THE INVENTION

The present invention relates to a planar inverted-F antenna (PIFA), and in particular to a PIFA having an extended grounding plane to ensure excellent antenna impedance matching characteristics and improved impedance bandwidth.

BACKGROUND OF THE INVENTION

An antenna plays a critical role for the transmission and receipt of electromagnetic energy in a wireless communication system. The electric characteristics of the antenna have a significant influence on the quality of communication, and are an indication for quality of wireless signal receipt and transmission. In various applications of products for transmission/receipt of wireless signals, antennas of various materials and configurations have been used. Proper selection of antennas can enhance the overall outside appearance of an electronic product that incorporates the antenna and also improve transmission of wireless signals, as well as reduce overall costs of the whole wireless facility.

Besides being good in wireless transmission and receipt, matching with the electronic product in which an antenna is included is also an important issue for the antenna. For example, for a mobile phone of which the appealing factors are being compact and light weight, and other portable wireless electronic device, such as a notebook computer, the use of an antenna must take into consideration both the overall outside appearance of the electronic product and excellent performance of signal transmission and receipt. Manufacturers of electronic products of these kinds have put in substantial effort to make the antennas of these products minimum and compact.

To make an antenna compact and minimized, a planar inverted-F antenna (PIFA) has been proposed. The PIFA has a nearly omni-directional radiation field and simple construction and has an operation length of around a quarter of the operation wavelength. Thus, the PIFA is most fit for Bluetooth devices, mobile phones, and other portable wireless electronic devices. Further, a PIFA can be made by simply using a metal conductor to which feeding element is provided and which is connected to the ground via short-circuit elements. Thus, the manufacturing cost is extremely low. In addition, the PIFA can be directly bonded by soldering to a circuit board of the electronic product.

A conventional PIFA comprises a ground plane, a short circuit piece, and a planar radiating plate, wherein the planar radiating plate is provided, at a predetermined location, with and connected to a signal transmission line. Such a predetermined location serves as a feeding point of the PIFA.

SUMMARY OF THE INVENTION

Although the conventional construction of the planar inverted-F antenna has the advantages of simple structure, operation length of the antenna being one quarter of the operation wavelength, compactness, and being suitable for portable electronic devices, yet it is still possible to further improve impedance matching of the conventional PIFA construction and also impedance bandwidth of the conventional PIFA.

Apparently, the PIFA can be of more market competitive advantages if, besides the above mentioned advantages of the conventional PIFA, impedance matching and impedance bandwidth of the PIFA can be further improved.

Thus, an objective of the present invention is to a planar inverted-F antenna with an extended grounding plan, wherein, without adding complication of the construction of the planar inverted-F antenna, the extended grounding plane in accordance with the present invention effectively improves antenna impedance matching and increases impedance bandwidth.

Another objective of the present invention is to provide an integrally-formed, single-feed, dual-band planar inverted-F antenna.

The technical solution adopted in the present invention to overcome the above discussed drawbacks includes an integrally-formed, three-dimensional, signal-feed, dual-band planar inverted-F antenna having an extended grounding plane. The planar inverted-F antenna in accordance with the present invention comprises a grounding metal plate; an extended grounding plane formed on and extending from a side edge of the grounding metal plate in a direction toward a feeding point by a predetermined distance; a short-circuit piece formed on a side edge of the grounding metal plate and having a predetermined height; at least one antenna signal radiating plate connected to the grounding metal plate by the short-circuit piece; and a feeding point extending from the antenna signal radiating plate in a direction toward the grounding metal plate and corresponding to the extended grounding plane and forming a predetermined gap with the extended grounding plane. In a preferred embodiment of the present invention, two independent antenna signal radiating plates in the form of metal strips respectively provides current paths for high and low frequencies.

In accordance with the present invention, with the extended grounding plane that is of a predetermined height and set corresponding to a feeding point formed on an antenna signal radiating plate connected to a short-circuit piece, a distance between the short-circuit piece and the feeding point can be properly set to realize excellent impedance matching, and the arrangement of the extended grounding plane also further improves the impedance matching and increases impedance bandwidth.

In accordance with a preferred embodiment of the present invention, two independent antenna signal radiating plates in the forms of metal strips can respectively provide current paths for high and low frequencies to thereby realize dual band radiations. The two operation frequencies can be controlled by individually adjusting the lengths of the metal strips to realize independent control of the operation points of the frequencies. Further, with the extended grounding plane, impedance bandwidth of the antenna can be increased.

The antenna in accordance with the present invention can be easily made with a single metal sheet as is currently adopted to form an integrally-formed single-feeding dual-band planar inverted-F antenna, which can be easily applied for mass production for industrial utilization.

BRIEF DESCRIPTION OF THE DRAWINGS

The present invention will be apparent to those skilled in the art by reading the following description of preferred embodiments thereof with reference to the drawings, in which.

DETAILED DESCRIPTION OF THE PREFERRED EMBODIMENTS

Figure 1:
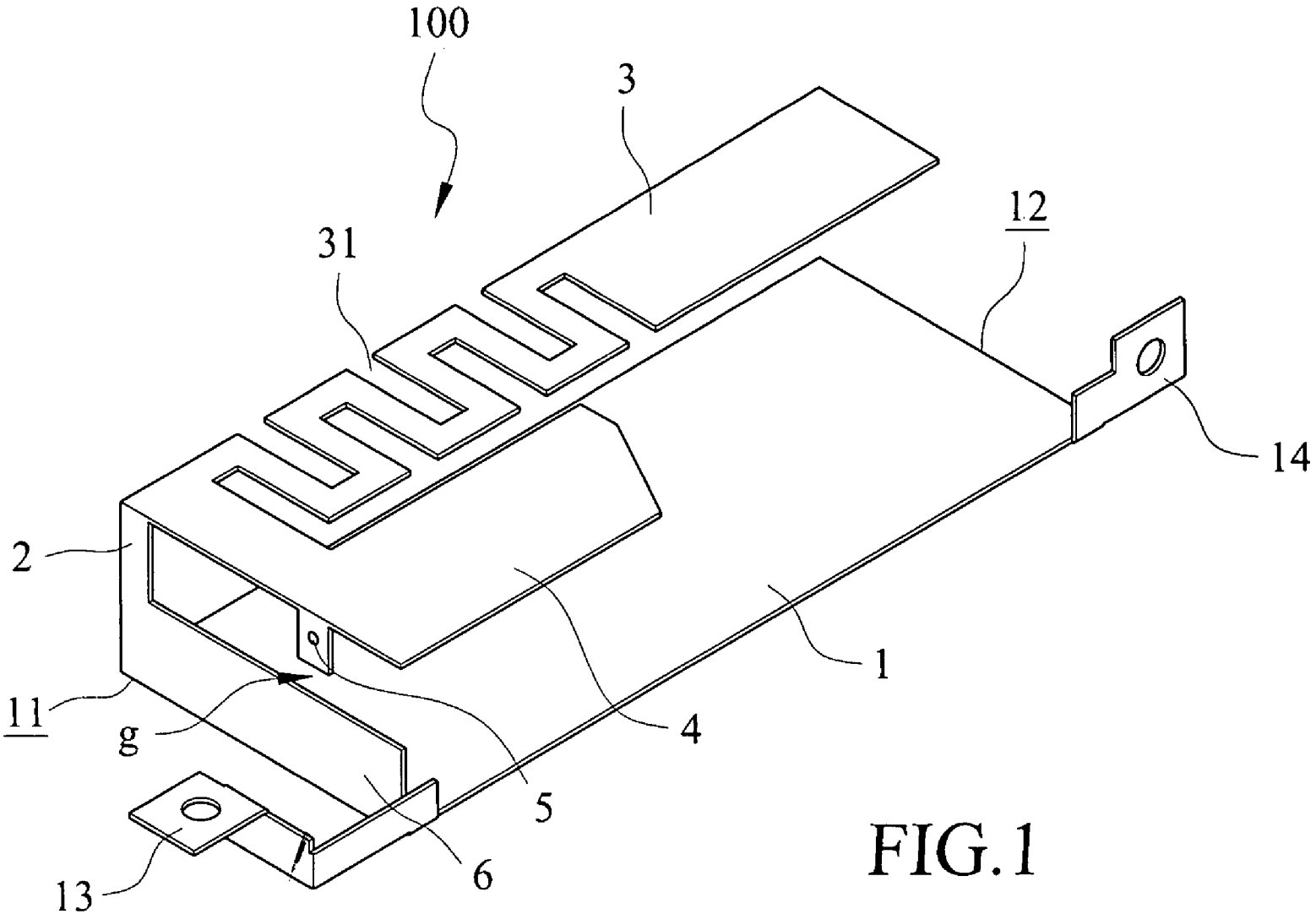
FIG. 1 is a perspective view of a planar inverted-F antenna constructed in accordance with a first embodiment of the present invention.

The present invention provides an integrally-formed three-dimensional single-feeding dual-band-radiation planar inverted-F antenna (PIFA) with extended grounding plane. Referring to FIG. 1, a planer inverted-F antenna with extended grounding plane in accordance with a first embodiment of the present invention, generally designated at 100, comprises a flat-plate-like grounding metal plate 1 having a first side edge 11 and an opposite second side edge 12.

A short-circuit piece 2 is formed on and extends upward from the first side edge 11 of the grounding metal plate 1 by a predetermined distance (height). The short-circuit piece 2 has a top end connected to a first antenna signal radiating plate 3. The first antenna signal radiating plate 3 is set substantially parallel to and spaced from the grounding metal plate 1 by a given distance to a current path for low frequency signals of the planar inverted-F antenna 100. The first antenna signal radiating plate 3 forms a plurality of slits 31 adjacent to the short-circuit piece 2.

A second antenna signal radiating plate 4 is arranged horizontally beside the first antenna signal radiating plate 3 and horizontally spaced therefrom by a predetermined distance. The second antenna signal radiating plate 4 is also set substantially parallel to and spaced from the grounding metal plate 1 by a given distance to provide a current path for high frequency signals of the planar inverted-F antenna 100. If desired, the spatial locations of the first antenna signal radiating plate 3 and the second antenna signal radiating plate 4 can be switched with each other.

The first antenna signal radiating plate 3 and the second antenna signal radiating plate 4 form two different current paths so that the antenna can be operated in a first resonant frequency (low frequency) with the first antenna signal radiating plate 3 and is also operable in a second resonant frequency (high frequency) with the second antenna signal radiating plate 4. Also, the formation of the slits 31 in the first antenna signal radiating plate 3 effectively increases an effective current path, while reducing the overall length of the first antenna signal radiating plate 3. Adjustment of the length of the second antenna signal radiating plate 4 is effective in individually adjusting the operation frequency of the high frequency band.

A feeding point 5 extends from the second antenna signal radiating plate 4 in a direction toward the first side edge 11 of the grounding metal plate 1 and corresponds to a top edge of an extended grounding plane 6. In the first embodiment of the present invention, the extended grounding plane 6 is a vertical grounding plane, which is vertically extended from the first side edge 11 of the grounding metal plate 1 by a predetermined distance (height) in a direction toward the second antenna signal radiating plate 4 and is spaced from the feeding point 5 by a gap g. In the embodiment illustrated, the short-circuit piece 2 is formed on the first side edge 11 of the grounding metal plate 1 close to the first antenna signal radiating plate 3 and the extended grounding plane 6 is also formed on the first side edge 11.

The present invention offers the adjustability of impedance matching by properly setting the distance between the short-circuit piece 2 and the feeding point 5 and also ensures improvement of the impedance matching through the addition of the extended grounding plane 6 to the overall antenna structure to thereby increase impedance bandwidth of the antenna.

The grounding metal plate 1 can be of a configuration of rectangular shape. Also, antenna fixing sections 13, 14 are selectively formed on extensions of the first and second side edges 11, 12 of the grounding metal plate 1 whereby the planar inverted-F antenna 100 can be secured to a desired location on a housing of a target electronic device (not shown) through any known fasteners, such as screws. The antenna fixing sections 13, 14 can also be respectively formed on the opposite side edges 11, 12. Or alternatively, the fixing sections 13, 14 can be formed on the same side edge 11 (or 12), or they can be formed on either one of the side edges and other edges of the grounding metal plate 1.

Figure 2:
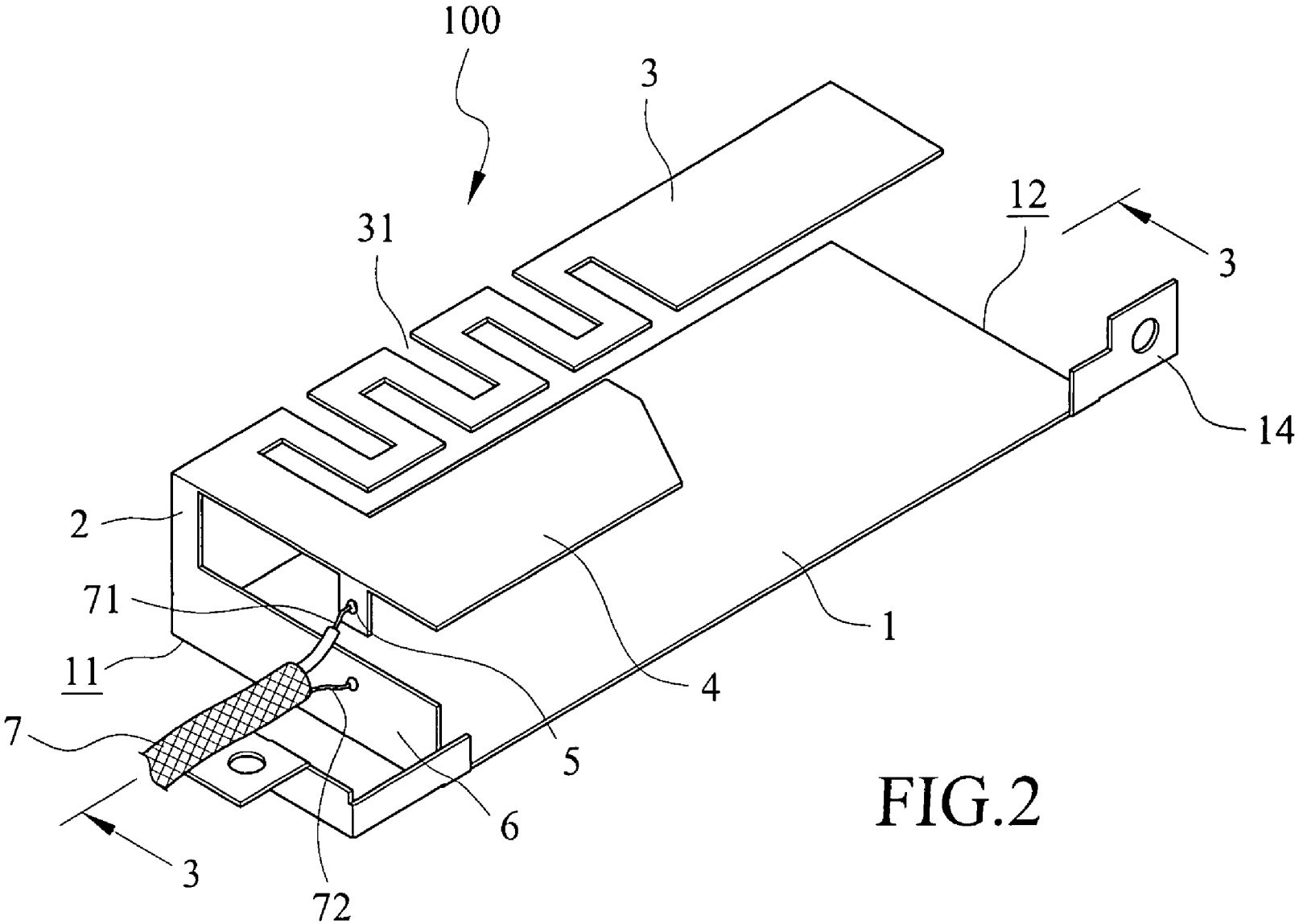
FIG. 2 is also a perspective view similar to FIG. 1 but showing a signal feeding line of a coaxial cable connected to a feeding point of the planar inverted-F antenna of the present invention, while a surrounding grounding line of the coaxial cable connected to an extended grounding plane of the antenna.
Figure 3:
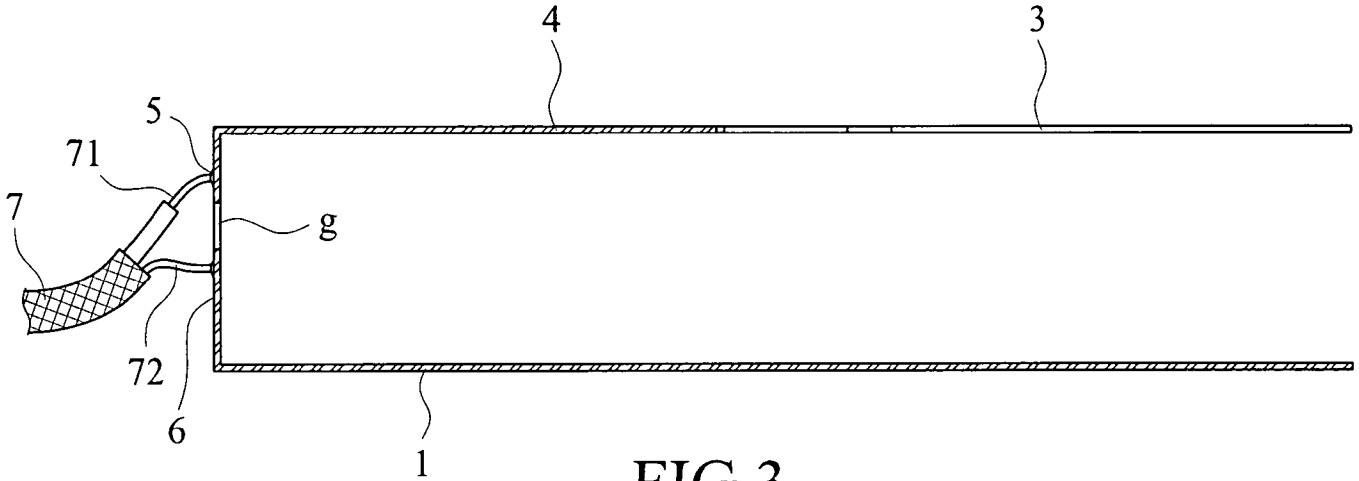
FIG. 3 is a cross-sectional view taken along line 3-3 of FIG. 2.
Figure 4:
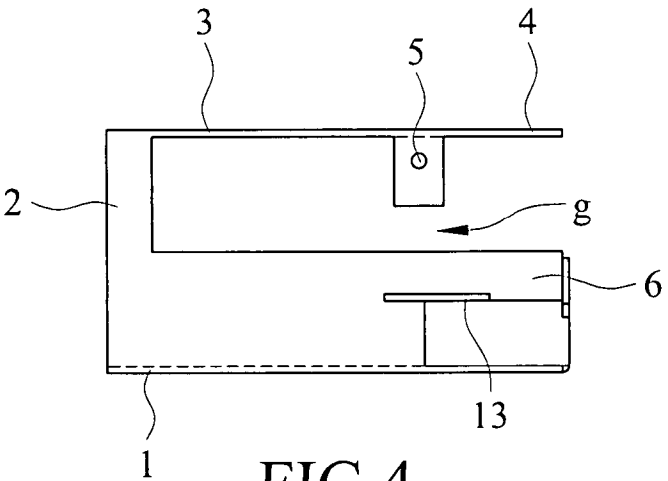
FIG. 4 is a side elevational view illustrating the spatial arrangement of a short-circuit piece, the feeding point, and the extended grounding plane of the antenna shown in FIG. 2.

Referring to FIG. 2, a signal feeding line 71 of a coaxial cable 7 is connected, by soldering, to the feeding point 5, while a surrounding grounding line 72 of the coaxial cable 7 is soldered to the extended grounding plane 6. FIG. 3 is a cross-sectional view taken along line 3-3 of FIG. 2, and similarly illustrates the signal feeding line 71 and the grounding line 72 of the coaxial cable 7 being respectively soldered to the feeding point 5 and the extended grounding plane 6. FIG. 4 is a side elevational view illustrating the spatial arrangement of the short-circuit piece 2, the feeding point 5, and the extended grounding plane 6.

In a manufacturing process of the planer inverted-F antenna 100 in accordance with the present invention, the antenna can be made as a unitary and integrally formed structure by properly bending and folding a metal plate into a three-dimensional structure that embodies the planar inverted-F antenna 100 of the present invention.

Figure 5:
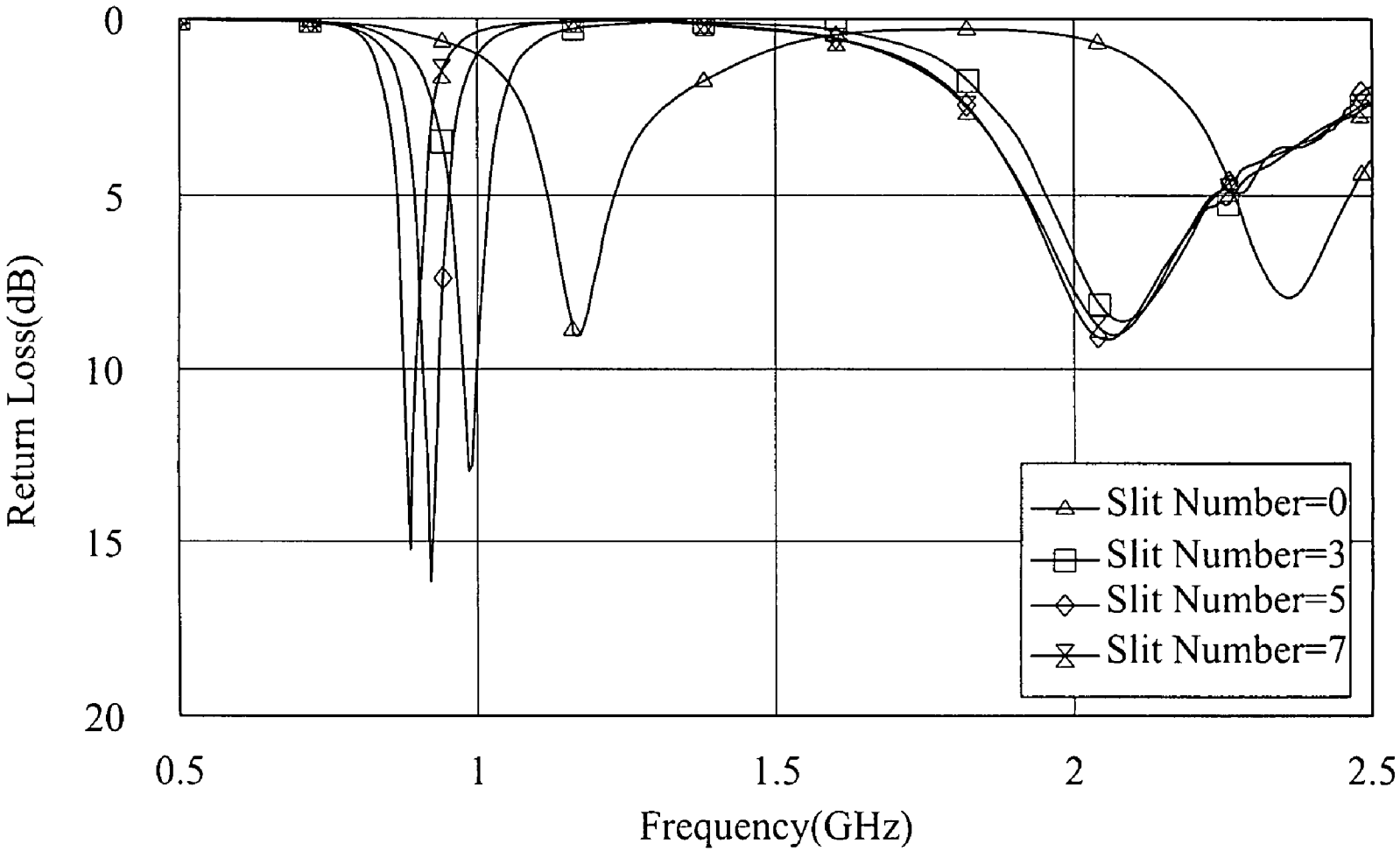
FIG. 5 shows response curves of return loss with respect to frequency for the antenna of the present invention that forms slits of different numbers.
Figure 6:
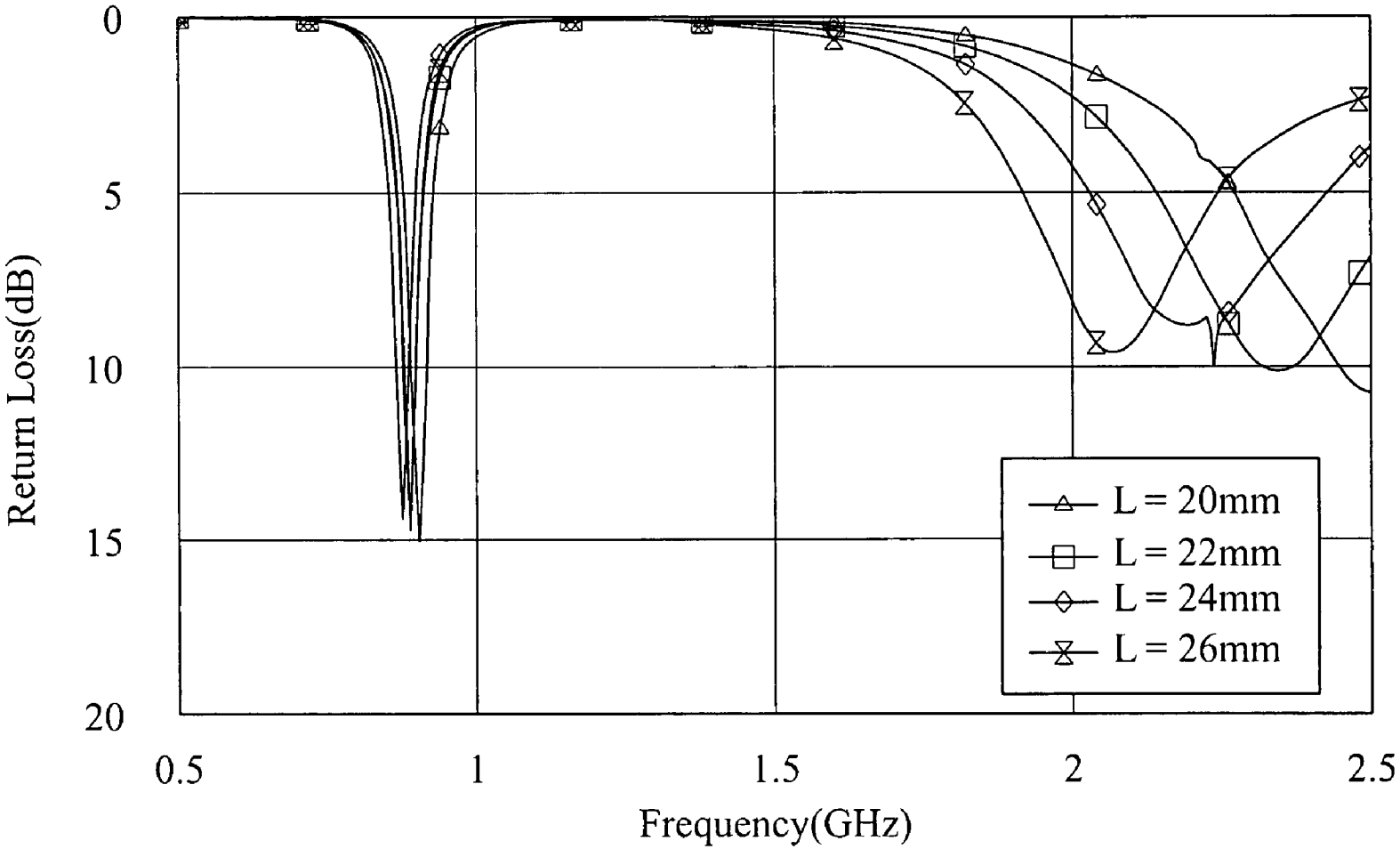
FIG. 6 shows response curves of return loss with respect to frequency for the antenna of the present invention that have antenna signal radiating plates of different lengths.
Figure 7:
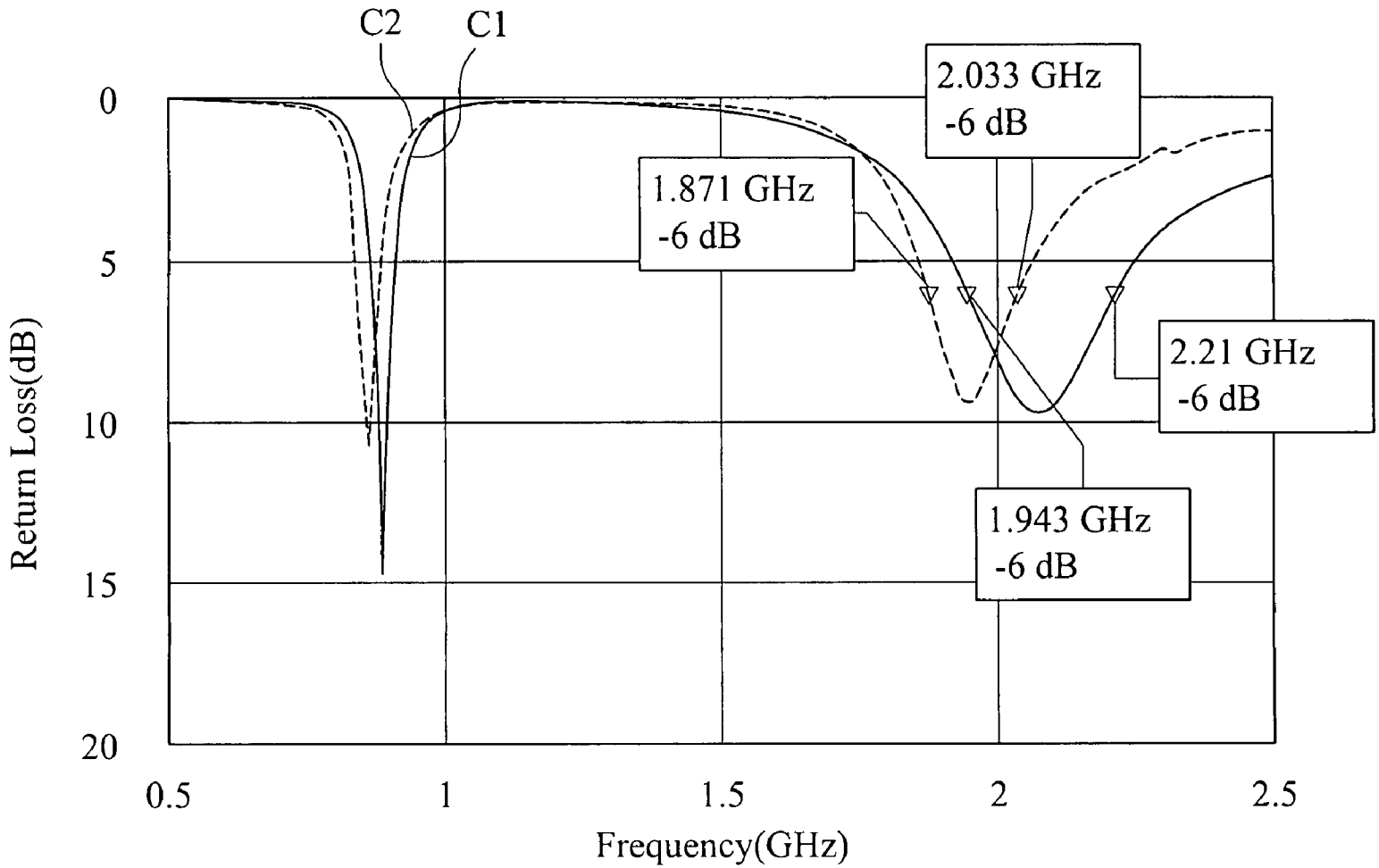
FIG. 7 shows response curves of return loss with respect to frequency for the antenna of the present invention and for an antenna without the extended grounding plane.

Result of simulation of characteristics of the antenna in accordance with the present invention is illustrated in FIGS. 5-7. Change of the number of the slits 31 that are formed in the first antenna signal radiating plate 3 correspondingly varies the operation point of a first resonant frequency of the antenna. As shown in FIG. 5, response curves of return loss with respect to frequency for different numbers of slits 31 are provided, which indicates that when the number of the slits 31 increases from zero (0) to seven (7), the first resonant frequency reduces from 1,170 MHz to 885 MHz. This is simply because that an increased number of slits indicates an increase of the effective current path, which makes frequency lowered.

As revealed by the curved of FIG. 5, changing the number of the slits only varies the operation point of the first resonant frequency, but does not influence a second resonant frequency. This means changing the number of the slits 31 only influences the low frequency, but not the high frequency. Thus, the low frequency resonant point can be independently controlled by setting different number of the slits.

FIG. 6 shows response curves of return loss with respect to frequency for different lengths of the second antenna signal radiating plate 4. FIG. 6 reveals that the operation point of the second resonant frequency of the antenna can be varied by changing the length of the second antenna signal radiating plate 4. As shown in FIG. 6, when the length of the second antenna signal radiating plate 4 increases from 20 mm to 26 mm, the second resonant frequency drops from 2,495 MHz to 2,068 MHz. This is because a greater length of the second antenna signal radiating plate 4 indicates increased effective current path, which lowers the frequency. Again, changing the length of the second antenna signal radiating plate 4 only varies the operation point of the second resonant frequency of the antenna, but does not influence the first resonant frequency. This means changing the length of the second antenna signal radiating plate 4 only influences the high frequency, but not the low frequency. Thus, the high frequency resonant point can be independently controlled by setting different length of the second antenna signal radiating plate 4.

FIG. 7 shows response curves of return loss with respect to frequency for the antenna of the present invention that includes the extended grounding plane and an antenna without the extended grounding plane. The planar inverted-F antenna that includes the extended grounding plane exhibits the response curve of return loss indicated by C1, while that for an antenna without the extended grounding plane is indicated by C2. It is clear from the curves of FIG. 7 that addition of the extended grounding plane 6 effectively improves the impedance matching for the antenna. With the addition of the extended grounding plane 6, bandwidth is increased from 162 MHz (which is obtained from 2.033 GHz minus 1.871 GHz) to 267 MHz (which is obtained from 2.21 GHz minus 1.943 GHz).

Figure 8:
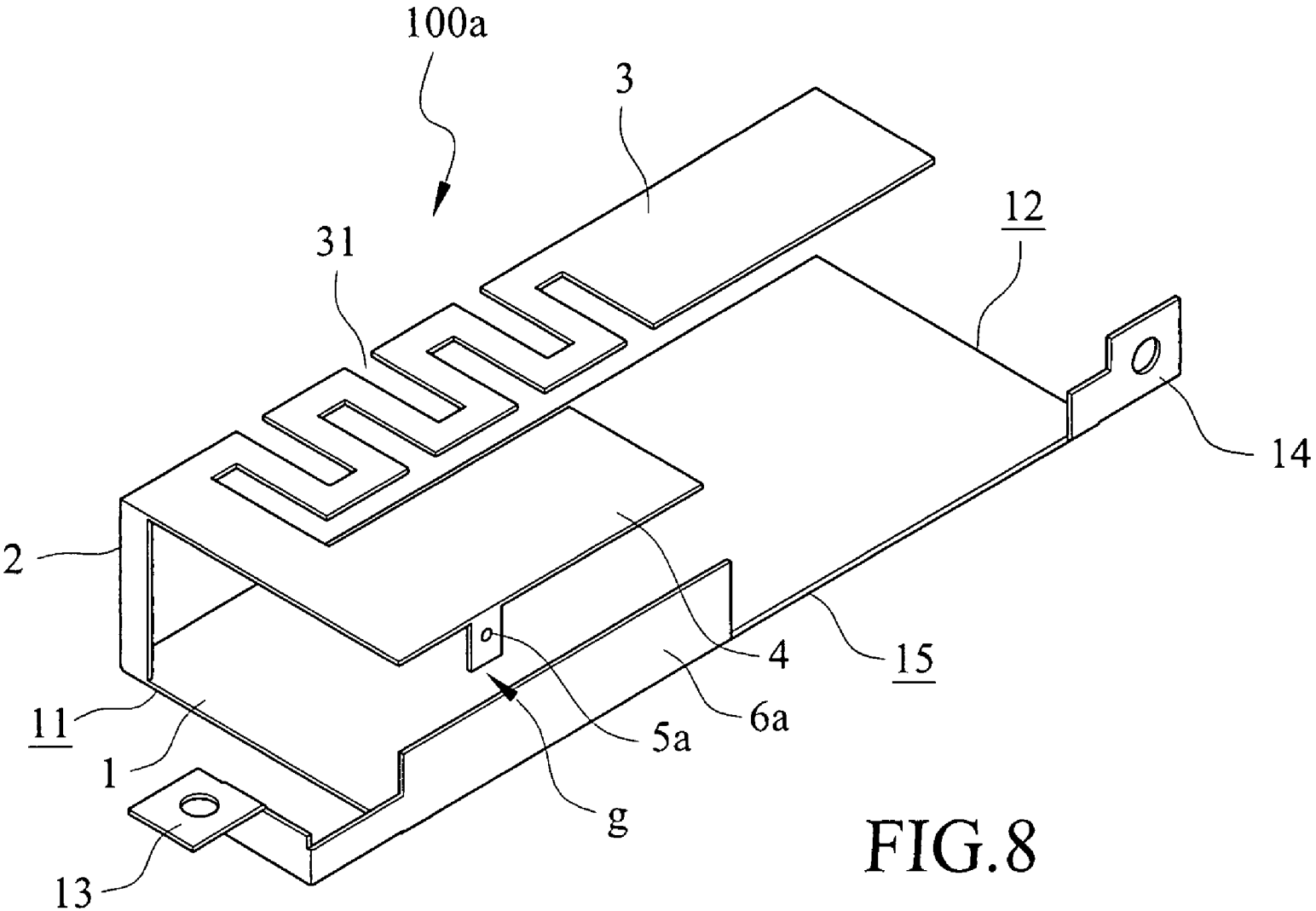
FIG. 8 is a perspective view of a planar inverted-F antenna constructed in accordance with a second embodiment of the present invention.

FIG. 8 shows a second embodiment of the planar inverted-F antenna with extended grounding plane in accordance with the present invention, generally designated at 100*a* for distinction. The planar inverted-F antenna 100*a* of the second embodiment is substantially identical to the planar inverted-F antenna 100 with reference to FIGS. 1 and 2; however, differences exist between the two antennas 100, 100*a* that the second embodiment planar inverted-F antenna 100*a* comprises an extended grounding plane 6*a* that is extended from a side edge 15 of the grounding metal plate 1 that corresponds to the second antenna signal radiating plate 4 in a direction toward the second antenna signal radiating plate 4 by a predetermined distance and that a feeding point 5*a* is formed on the second antenna signal radiating plate 4 at a location corresponding to the extended grounding plane 6*a* and downward extends toward a top edge of the extended grounding plane 6*a*, whereby a predetermined gap g is present between the top edge of the extended grounding plane 6*a* and the feeding point 5*a*. In the second embodiment, the short-circuit piece 2 is formed on the first side edge 11 of the grounding metal plate 1 close to the first antenna signal radiating plate 3, while the extended grounding plane 6*a* is formed on another side edge 15 that is adjacent to the second antenna signal radiating plate 4. With this structure, similar effect and function as those described with reference to the first embodiment can be realized.

The present invention has been described with reference to embodiments that are associated with dual-frequency applications with two antenna signal radiating plates. However, it is apparent that the present invention is also applicable to single band applications with only one signal metal radiating plate.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A planar inverted-F antenna comprising:

a grounding metal plate;

a short-circuit piece formed on a first side edge of the grounding metal plate and having a predetermined height;

a first antenna signal radiating plate connected to the grounding metal plate by the short-circuit piece and substantially parallel to and spaced from the grounding metal plate by a first predetermined distance to form a current path for a first resonant frequency of the antenna;

a second antenna signal radiating plate connected to the grounding metal plate by the short-circuit piece and substantially parallel to and spaced from the grounding metal plate by the first predetermined distance so as to be in a same horizontal plane as the first antenna signal radiating plate, the second antenna signal radiating plate forming a current path for a second resonant frequency of the antenna;

a feeding point formed at a predetermined location on the second antenna signal radiating plate; and an extended grounding plane formed on and extending from a side edge of the grounding metal plate in a direction toward the feeding point by a second predetermined distance and spaced from the feeding point by a third predetermined distance.

2. The planar inverted-F antenna as claimed in claim 1, wherein the extended grounding plane vertically extends from the side edge of the grounding metal plate in an upward direction toward the feeding point.

3. The planar inverted-F antenna as claimed in claim 1, wherein the short-circuit piece is formed on the first side edge of the grounding metal plate that is close to the first antenna signal radiating plate and wherein the side edge of the grounding metal plate on which the extended grounding plane is formed is the first side edge.

4. The planar inverted-F antenna as claimed in claim 1, wherein the short-circuit piece is formed on the first side edge of the grounding metal plate that is close to the first antenna signal radiating plate and different from the side edge of the grounding metal plate on which the extended grounding plane is formed.

5. The planar inverted-F antenna as claimed in claim 1, wherein the first antenna signal radiating plate forms a plurality of slits for varying an operation point of the first resonant frequency.

6. The planar inverted-F antenna as claimed in claim 1, wherein the second antenna signal radiating plate has a length, variation of which changes an operation point of the second resonant frequency.

7. The planar inverted-F antenna as claimed in claim 1, wherein the grounding metal plate forms at least one fixing section adapted to fix the planar inverted-F antenna to a target electronic device.

8. The planar inverted-F antenna as claimed in claim 1, wherein the feeding point is adapted to connect a signal feeding line of a coaxial cable, a surrounding grounding line of the coaxial cable being connected to the extended grounding plane.

9. A planar inverted-F antenna comprising:

a grounding metal plate;

a short-circuit piece formed on a first side edge of the grounding metal plate and having a predetermined height;

at least one antenna signal radiating plate connected to the grounding metal plate by the short-circuit piece and substantially parallel to and spaced from the grounding metal plate by a predetermined distance to form a current path for a resonant frequency of the antenna;

a feeding point formed at a predetermined location on the antenna signal radiating plate; and an extended grounding plane formed on and extending from a side edge of the grounding metal plate in a direction toward the feeding point by a predetermined distance so as to be directly under the feeding point in a direction perpendicular to a top surface of the grounding metal plate and a bottom surface of the antenna signal radiating plate and spaced from the feeding point by a predetermined distance.

10. The planar inverted-F antenna as claimed in claim 9, wherein the extended grounding plane vertically extends from the side edge of the grounding metal plate in an upward direction toward the feeding point.

11. The planar inverted-F antenna as claimed in claim 9, wherein the short-circuit piece is formed on the first side edge of the grounding metal plate that is close to the antenna signal radiating plate and wherein the side edge of the grounding metal plate on which the extended grounding plane is formed is the first side edge.

12. The planar inverted-F antenna as claimed in claim 9, wherein the short-circuit piece is formed on the first side edge of the grounding metal plate that is close to the antenna signal radiating plate and different from the side edge of the grounding metal plate on which the extended grounding plane is formed.

13. The planar inverted-F antenna as claimed in claim 9, wherein the antenna signal radiating plate forms a plurality of slits for varying an operation point of the resonant frequency.

14. The planar inverted-F antenna as claimed in claim 9, wherein the antenna signal radiating plate has a length, variation of which changes an operation point of the resonant frequency.

15. The planar inverted-F antenna as claimed in claim 9, wherein the grounding metal plate forms at least one fixing section adapted to fix the planar inverted-F antenna to a target electronic device.

16. The planar inverted-F antenna as claimed in claim 9, wherein the feeding point is adapted to connect a signal feeding line of a coaxial cable, a surrounding grounding line of the coaxial cable being connected to the extended grounding plane.

* * * * *